US009031434B2

(12) United States Patent
Tsukada

(10) Patent No.: US 9,031,434 B2
(45) Date of Patent: May 12, 2015

(54) DEVELOPING APPARATUS HAVING CONTROLLER FOR CONTROLLING DRIVE TIME OF SCREW MEMBER

(71) Applicant: Canon Kabushiki Kaisha, Tokyo (JP)

(72) Inventor: Yoshiro Tsukada, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 121 days.

(21) Appl. No.: 13/739,437

(22) Filed: Jan. 11, 2013

(65) Prior Publication Data

US 2013/0183052 A1 Jul. 18, 2013

(30) Foreign Application Priority Data

Jan. 13, 2012 (JP) ..... 2012-005344

(51) Int. Cl.
*G03G 15/08* (2006.01)
*G03G 15/09* (2006.01)

(52) U.S. Cl.
CPC ..... *G03G 15/0832* (2013.01); *G03G 15/0865* (2013.01); *G03G 15/0891* (2013.01); *G03G 15/0893* (2013.01); *G03G 15/09* (2013.01)

(58) Field of Classification Search
CPC ..... G03G 15/0802; G03G 15/0887; G03G 15/0889; G03G 15/0893; G03G 2215/0802; G03G 2215/0819; G03G 2215/0822; G03G 2215/0827; G03G 2215/0838
USPC ..... 399/43, 44, 53, 254, 255, 256
See application file for complete search history.

(56) References Cited

U.S. PATENT DOCUMENTS

| | | | | |
|---|---|---|---|---|
| 5,005,517 | A * | 4/1991 | Fukui et al. | 118/689 |
| 8,385,754 | B2 | 2/2013 | Hirobe et al. | |
| 2008/0240757 | A1* | 10/2008 | Suzuki | 399/53 |
| 2010/0098447 | A1* | 4/2010 | Ootsuka | 399/53 |
| 2010/0189455 | A1* | 7/2010 | Kim | 399/53 |
| 2011/0026959 | A1* | 2/2011 | Itaya | 399/53 |
| 2011/0052221 | A1 | 3/2011 | Hirobe et al. | |
| 2012/0155900 | A1* | 6/2012 | Suzuki | 399/53 |

FOREIGN PATENT DOCUMENTS

| | | | |
|---|---|---|---|
| JP | 6-236109 | A | 8/1994 |
| JP | 2001142285 | A * | 5/2001 |
| JP | 2009092911 | A * | 4/2009 |
| JP | 2009-192554 | A | 8/2009 |
| JP | 2009-204779 | A | 9/2009 |
| JP | 2010-152098 | A | 7/2010 |
| JP | 2011-48117 | A | 3/2011 |
| JP | 2011112657 | A * | 6/2011 |

* cited by examiner

*Primary Examiner* — Robert Beatty
(74) *Attorney, Agent, or Firm* — Fitzpatrick, Cella, Harper & Scinto

(57) ABSTRACT

An image forming apparatus includes an image bearing member, a developer carrying member, a first chamber for permitting feeding of the developer to the developer carrying member, and a second chamber for forming a circulation path of the developer at end portions thereof. The second chamber collects the developer from the developer carrying member at an opposing position, and a screw member feeds the developer contained in the first and second chambers. In addition, a supplying portion supplies a developer, a discharging portion, provided in the circulation path, causes an excessive developer to overflow, and a controller controls, on the basis of information on a first drive time from a start of rotation of the screw member to an end of a developing operation, a second drive time from the end of the developing operation to a stop of the rotation of the screw member.

9 Claims, 11 Drawing Sheets

DEVELOPING APPARATUS HAVING CONTROLLER FOR CONTROLLING DRIVE TIME OF SCREW MEMBER

FIELD OF THE INVENTION AND RELATED ART

The present invention relates to an image forming apparatus including a developing device of a vertical stirring type in which an excessive developer resulting from supply of a developer containing a carrier is caused to overflow. Specifically, the present invention relates to control for discharging the excessive developer in the developing device in an operation in a post-rotation mode when a short-time image forming job is continued.

The image forming apparatus in which the developing device of a two-component developing system wherein a developer containing a toner and the carrier is used for developing an electrostatic image formed on an image bearing member into a toner image is mounted has been widely used. In the field of the developing device of the two-component developing system, in addition to a developing device of a horizontal stirring type in which feeding paths of the developer are horizontally provided and arranged, in recent years, a developing device of a vertical stirring type in which the feeding paths are provided at two levels different in height has been put into practical use (Japanese Laid-Open Patent Application (JP-A) 2009-192554).

The developing device of the vertical stirring type will be described with reference to FIG. 3. A vertical stirring type developing device 1 includes a first chamber 3 and a second chamber 4 which are vertically provided, and transfers a developer in its height direction at its end portions 11 and 12 to circulate the developer. During image formation, the developer fed by a second screw member 6 is delivered to the first chamber 3 through an opening 11 in a downstream side of the second chamber 4. The delivered developer is fed by a first screw member 5 and is dropped into the second chamber 4 through an opening 12 in a downstream side of the first chamber 3.

To the developing device 1, a developer higher in toner ratio than the circulating developer is supplied from a supplying portion 35 in an amount corresponding to an amount of the toner consumed by the image formation. The developer which becomes excessive in the developing device 1 by the supply is caused to overflow from a discharging portion 13, so that an amount of the developer in the developing device 1 is kept at a constant level.

In JP-A 2009-192554, a developer surface (level) detecting sensor is provided in a downstream side of the second chamber 4, and on the basis of an output of the developer surface detecting sensor, a rotational speed of the second screw member 6 is adjusted. In a state in which the developer in a developer container 2 is steadily circulated, when the developer in the second chamber 4 becomes excessive, an amount of the developer pushed up from the second chamber 4 to the first chamber 3 is increased, so that the surface of the developer fed in the first chamber 3 is heightened.

In the vertical stirring type developing device 1, when the developing device is stopped, as shown in FIG. 4, the developer in the first chamber 3 is dropped into the second chamber 4, so that the amount of the developer in the first chamber 3 is decreased. In this state, when the developing device is actuated, the developer does not flow into the first chamber 3 until the developer in the second chamber (stirring chamber) 4 runs over the opening 11 but in the other hand, the developer in the first chamber 3 is continuously dropped into the second chamber 4 through the opening 12, so that the amount of the developer in the first chamber 3 is further decreased. When the developer in the first chamber 3 is decreased in amount, a level of the developer at the discharging portion 13 is lowered, so that an overflow function through the discharging portion 13 is not performed.

For this reason, when the developing device 1 is actuated from a rest state and one sheet print job in which printing of a single sheet is executed and then stopped is repeated, the supplied with image formation is continuously accumulated in the developing device 1 without overflowing, so that the amount of the developer becomes excessive. When the developer amount in the developing device 1 becomes excessive, as described later, problems such as advance of deterioration of the developer and an increase in electric energy consumption are liable to occur.

In this case, as shown in FIG. 3, when the developing device 1 is idled and then the image formation is started after the developer in the developing device 1 is in a steady state, it is possible to obviate the problem that the developer amount in the developing device 1 is excessive. However, a time required from input of an image forming job to output of a first print becomes long and therefore apparent productivity of the image forming apparatus is largely lowered.

Further, when the printing of the single sheet is executed, a developer surface balance in the steady state is destroyed and therefore a developer level in the developing chamber is lowered. Accordingly, the developer surface is lowered in a downstream side of the developing chamber with respected to a feeding direction and thus the developer to be supplied to a developing sleeve is insufficient, so that there is a possibility of a lowering in image density.

SUMMARY OF THE INVENTION

A principal object of the present invention is to provide an image forming apparatus capable of suppressing a problem due to a fluctuation of an amount of a developer in a developing device even when a one-sheet print job which does not wait a steady state of circulation of the developer in the developing device is repeated.

According to an aspect of the present invention, there is provided an image forming apparatus comprising: an image bearing member on which an electrostatic image is to be formed; a developer carrying member for carrying a developer including a toner and a carrier to develop the electrostatic image on the image bearing member; a first chamber for permitting feeding of the developer to the developer carrying member; a second chamber, provided at a position different in height from the first chamber, for forming a circulation path of the developer by communicating with the first chamber at end portions thereof, wherein the second chamber collects the developer from the developer carrying member at an opposing position to the developer carrying member; a screw member for feeding the developer contained in the first chamber and the second chamber; a supplying portion for supplying a developer including a toner and a carrier to compensate for the toner consumed by image formation; a discharging portion, provided in the circulation path, for causing an excessive developer to overflow; and a controller for controlling, on the basis of information on a first drive time from a start of rotation of the screw member for a start of the image formation to an end of a developing operation, a second drive time from the end of the developing operation to a stop of the rotation of the screw member.

These and other objects, features and advantages of the present invention will become more apparent upon a consideration of the following description of the preferred embodiments of the present invention taken in conjunction with the accompanying drawings.

Figure 5:
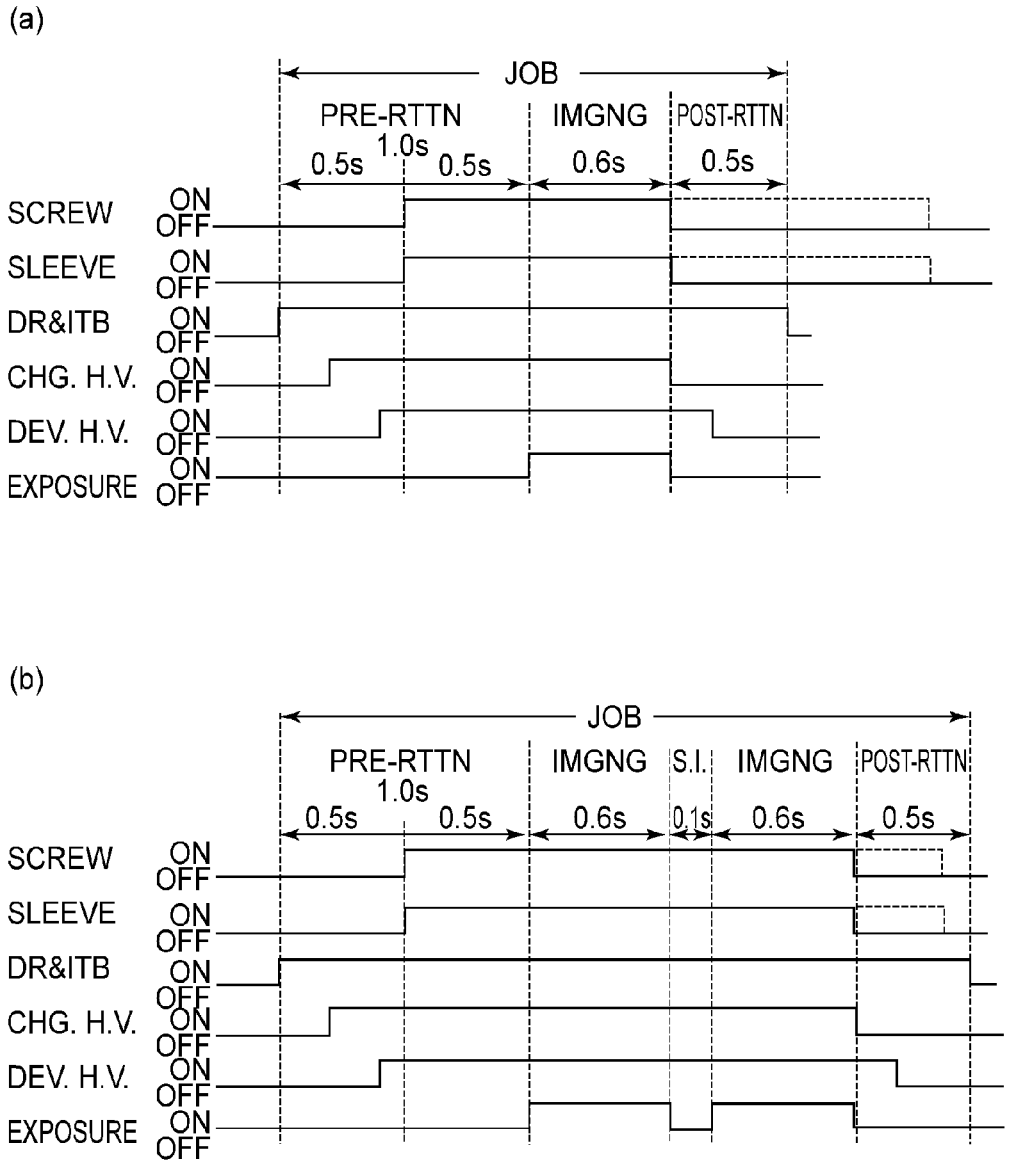

Parts (a) and (b) of FIG. 5 are illustrations of operations in post-rotation modes in a Comparative Embodiment.

Figure 6:
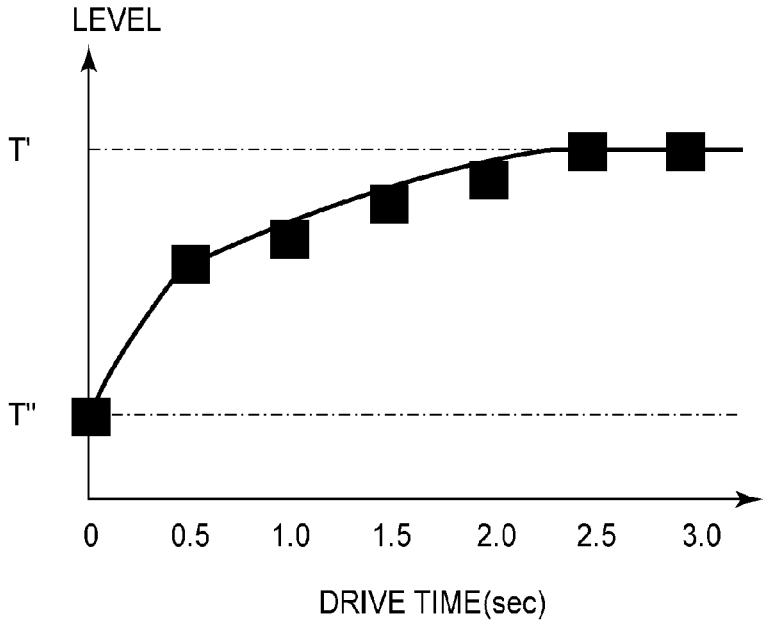

FIG. 6 is a graph showing a change in developer surface in a developing chamber after actuation of the developing device.

Figure 7:
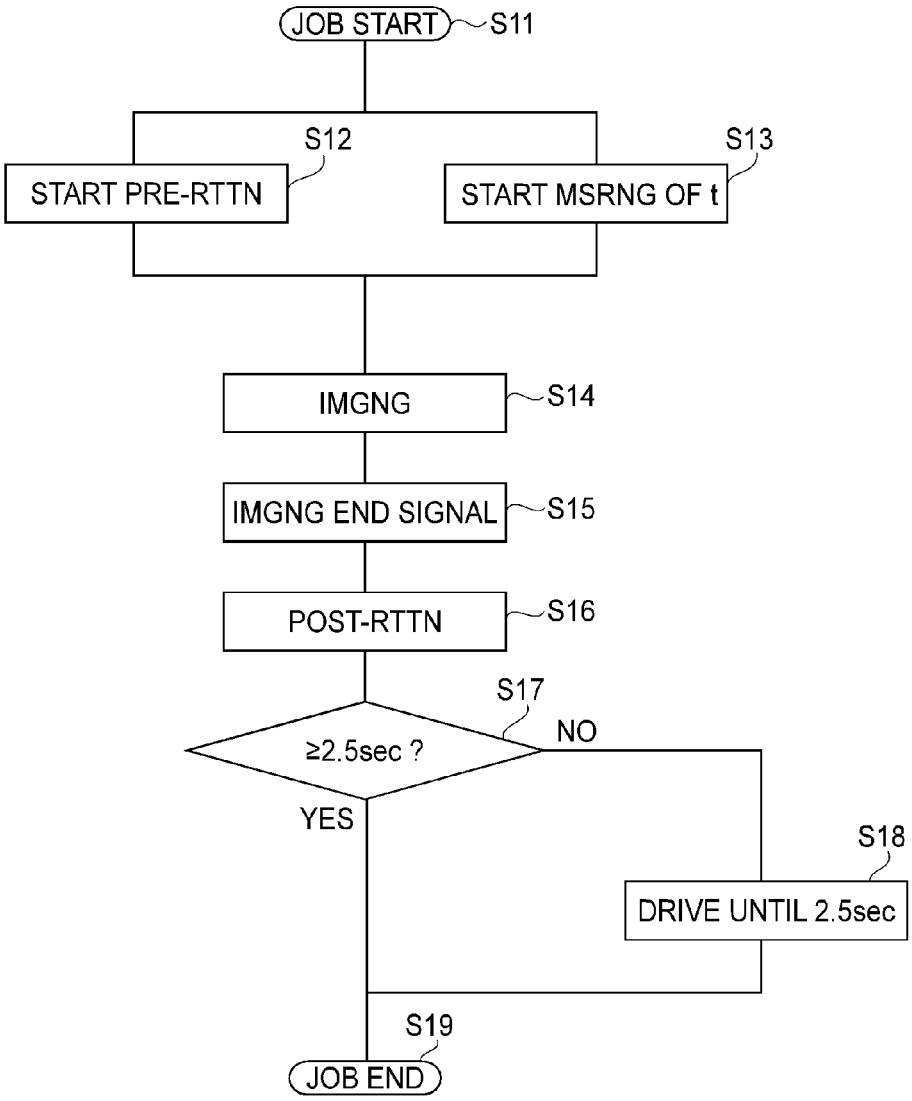

FIG. 7 is a flow chart of an operation in a post-rotation mode in Embodiment 1.

Figure 8:
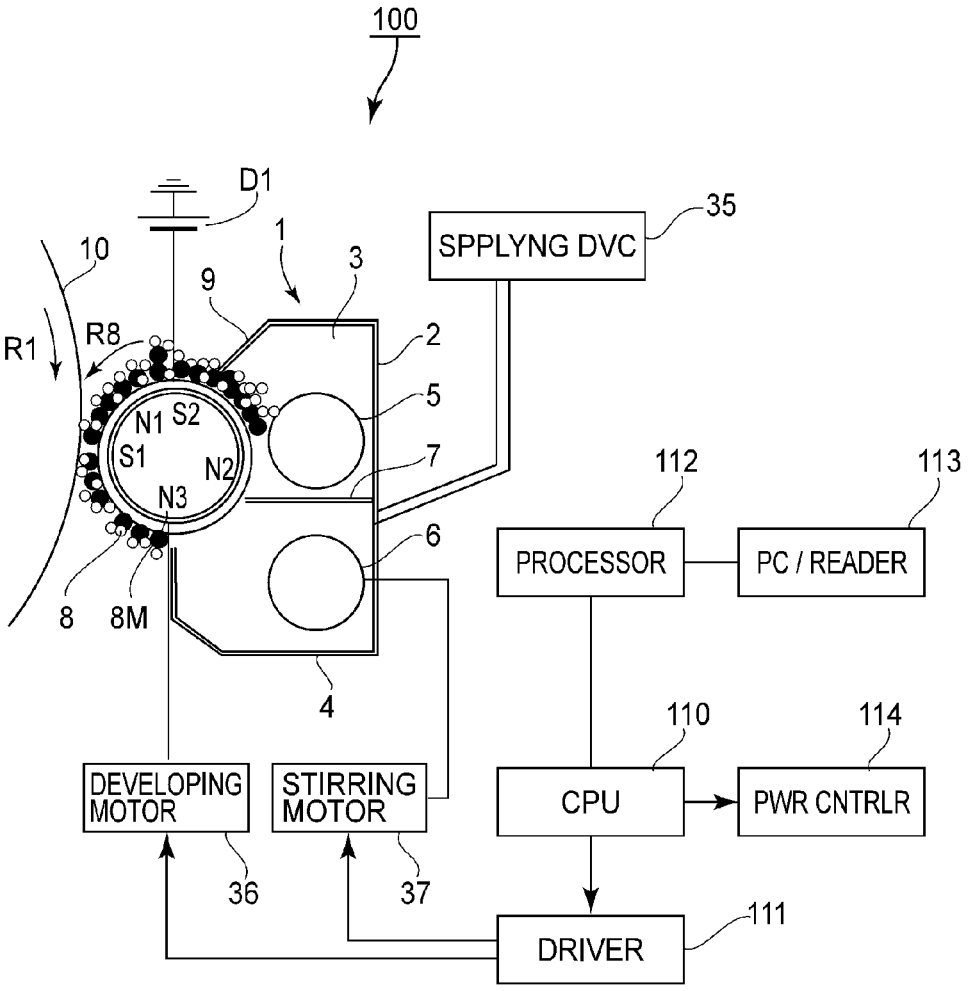

FIG. 8 is an illustration of a structure of a developing device in Embodiment 2.

Figure 9:
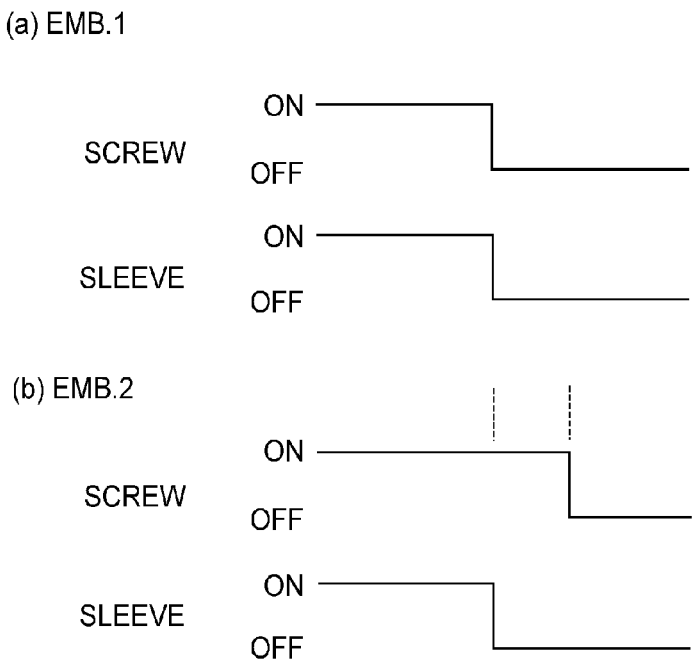

Parts (a) and (b) of FIG. 9 are time charts of operations in post-rotation modes in Embodiments 1 and 2, respectively.

Figure 10:
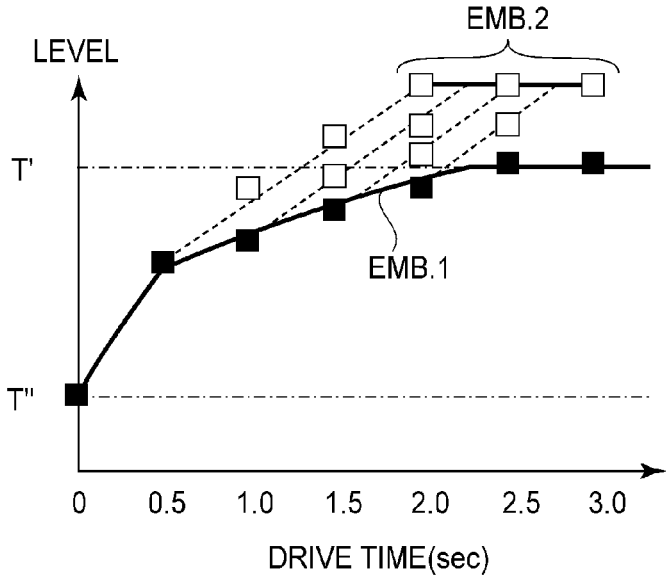

FIG. 10 is a graph showing a change in developer surface after a developing sleeve is stopped.

Figure 11:
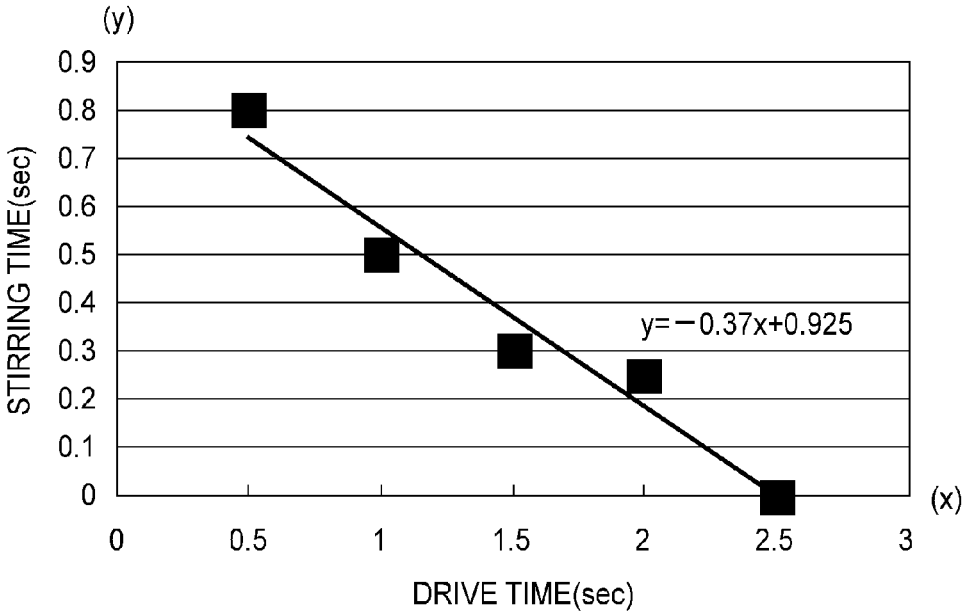

FIG. 11 is a graph for illustrating a necessary additive time of a developing screw and a stopping screw.

Figure 12:
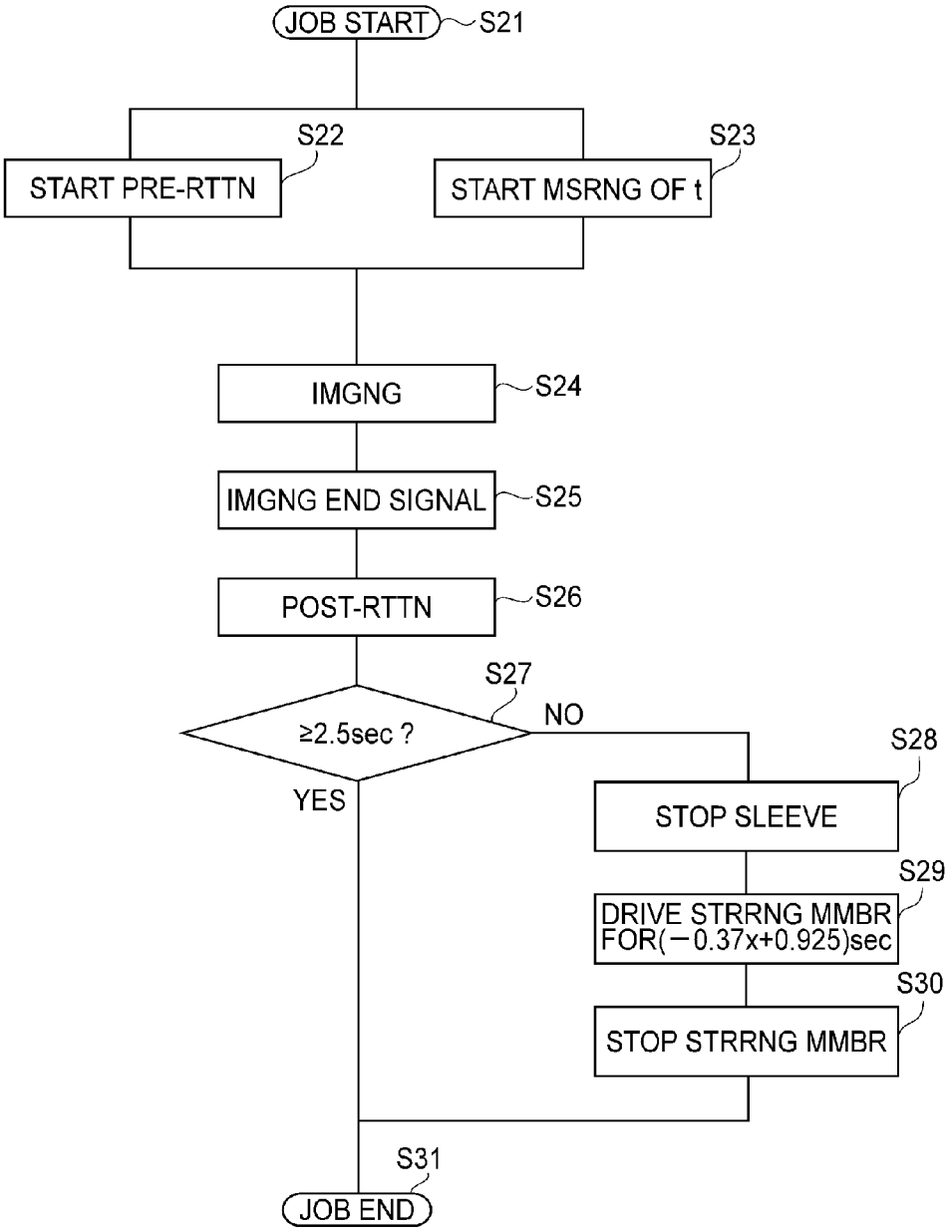

FIG. 12 is a flow chart of an operation in a post-rotation mode in Embodiment 2.

Figure 13:
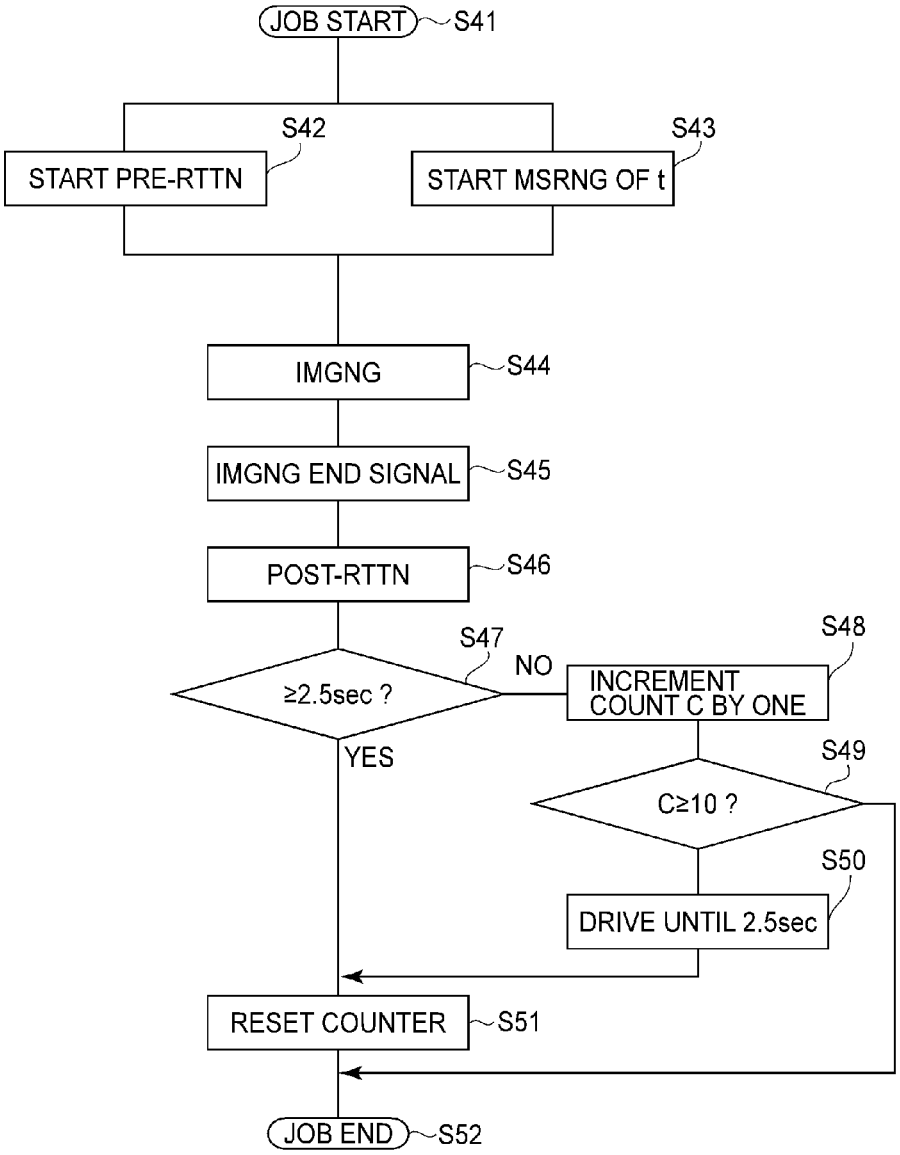

FIG. 13 is a flow chart of an operation in a post-rotation mode in Embodiment 3.

DESCRIPTION OF THE PREFERRED EMBODIMENTS

Hereinbelow, embodiments of the present invention will be described specifically with reference to the drawings. The present invention can also be carried out in other embodiments in which a part or all of constitutions of the following embodiments are replaced with alternative constitutions so long as a one-sheet print job is executed by a vertical stirring type developing device, an amount of a developer discharged in an operation in a post-rotation mode is larger than that in an operation in a normal mode.

Therefore, an image forming apparatus in the present invention can be carried out irrespective of full-color image formation, monochromatic image formation, a one-drum type, a tandem type, a direct transfer type, a recording material conveyance type, an intermediary transfer type, a type of a recording material, a charging type, an exposure type, a transfer type, and a fixing type. In the following embodiments, only a major part of the image forming apparatus relating to formation and transfer of the toner image will be described but the present invention can be carried out in various fields of apparatuses or machines such as printers various printing machines, copying machines, facsimile machines, and multi-function machines.

<Image Forming Apparatus>

Figure 1:
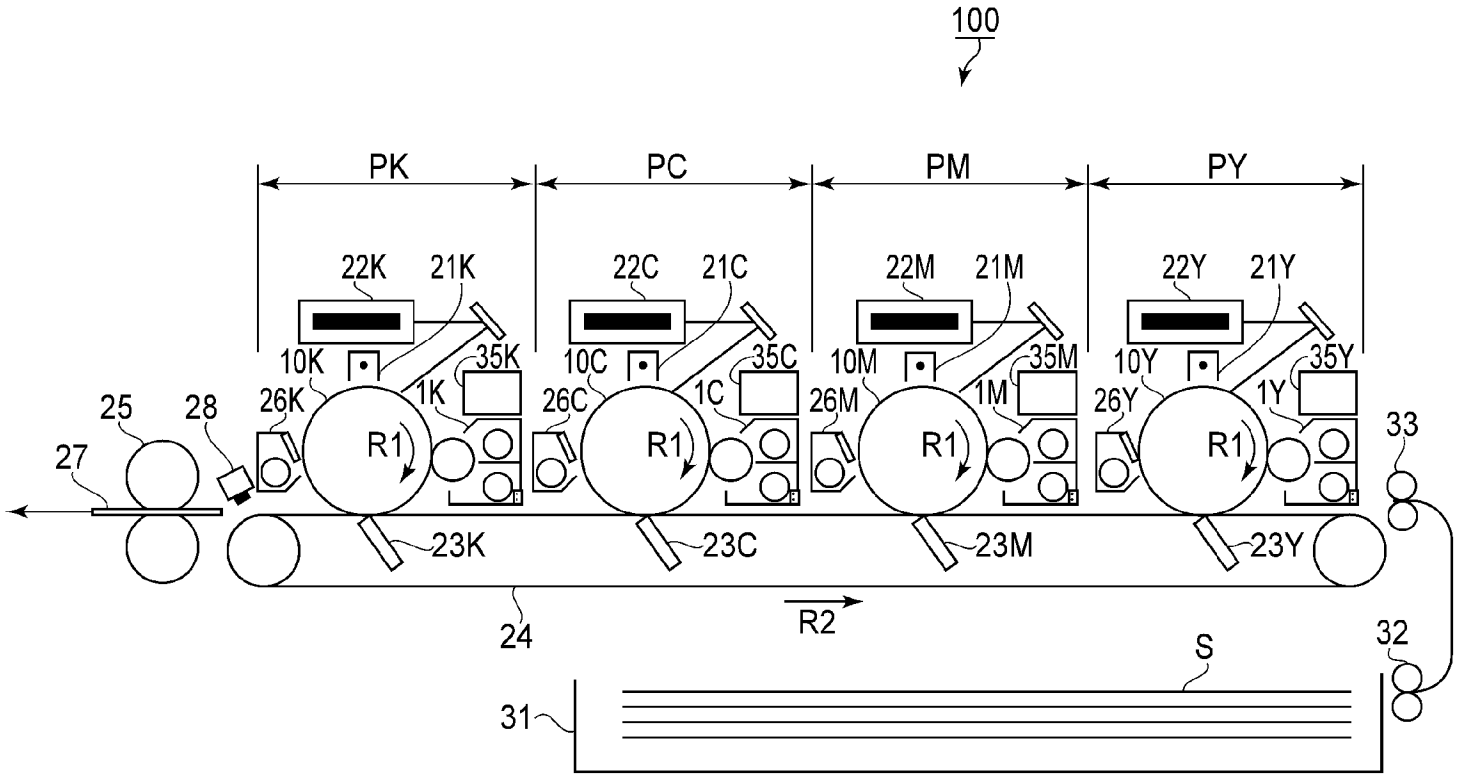
FIG. 1 is an illustration of a structure of an image forming apparatus.

FIG. 1 is an illustration of a structure of an image forming apparatus 100. As shown in FIG. 1, the image forming apparatus 100 is a recording material conveyer belt type full-color printer of the tandem type in which image forming portions PY, PM, PC and PK are disposed along a recording material conveyer belt 24.

A separating roller 32 separates the recording material S, one by one, pulled out from a recording material cassette 31 and feeds the recording material S to a registration roller 33. The registration roller 33 sends the recording material S to the recording material conveyer belt 24 by timing the recording material to the toner images on a photosensitive drum 10Y.

At the image forming portion PY, a yellow toner image is formed on the photosensitive drum 10Y and then is primary-transferred onto the recording material S carried on the recording material conveyer belt 24. At the image forming portion PY, a magenta toner image is formed on a photosensitive drum 10M and then is primary-transferred onto the recording material S carried on the recording material conveyer belt 24. At the image forming portions PC and PK, a cyan toner image and a black toner image are formed on a photosensitive drum 10C and a photosensitive drum 10K, respectively, and are primary-transferred onto the recording material S carried on the recording material conveyer belt 24.

The recording material S on which the four color toner images transferred is curvature-separated from the recording material conveyer belt 24 and then is set to a fixing device 25. The recording material S is heated and pressed by a fixing device 25, so that the toner images are fixed on a surface of the recording material S. Thereafter, the recording material S is discharged to the outside of the image forming apparatus 100.

The image forming portions PY, PM, PC and PK have the substantially same constitution except that the colors of toners of yellow for a developing device 1Y provided at the image forming portion PY, of magenta for a developing device 1M provided at the image forming portion PM, of cyan for a developing device 1C provided at the image forming portion PC, and of black for a developing device 1K provided at the image forming portion PK are different from each other. In the following description, constituent members (portions) are represented by reference numerals (symbols) from which suffixes Y, M, C and K for representing differentiation among the constituent members (portions) for the image forming portions PY, PM, PC and PK are omitted, and a constitution and operation of an image forming portion P will be collectively described.

At the image forming portion P, around the photosensitive drum 10, a corona charger 21, an exposure device 22, the developing device 1, a transfer blade 23 and a drum cleaning device 26 are disposed. The photosensitive drum 10 is constituted by forming a photosensitive layer at its outer peripheral surface which is rotated in an arrow R1 direction (FIG. 2) at a predetermined process speed.

The surface of the photosensitive drum 10 is irradiated with charged particles with corona discharge, thus being electrically charged uniformly to a negative-polarity dark portion potential VD. The exposure device 22 writes (forms) a latent image for an image on the charged surface of the photosensitive drum 10 by scanning of the charged surface through a rotation mirror with a laser beam obtained by ON-OFF modulation of scanning line image data expanded from a separated color image for an associated color. The developing device 1 reversely develops the electrostatic image into the toner image by supplying the toner to the photosensitive drum 10.

The transfer blade 23 urges the recording material conveyer belt 24 to form a toner image transfer portion between the photosensitive drum 10 and the recording material conveyer transfer belt 24. By applying a DC voltage, of an opposite polarity to a charge polarity of the toner, to the transfer blade 23, the toner image carried on the photosensitive drum 10 is transferred onto the recording material S carried on the recording material conveyer belt 24.

<Developer>

The developing device 1 uses a developer (two-component developer) containing a negatively chargeable toner (non-magnetic) and a positively chargeable carrier (with low magnetization and high resistance).

The toner is constituted by using, in appropriate amounts, a binder resin such as styrene-based resin or polyester resin, a colorant such as carbon black or a dye, a parting agent such as wax, a charge control agent, and the like. The toner can be manufactured by an ordinary manufacturing method such as a pulverization method or a polymerization method.

The toner may preferably have a triboelectric charge amount of not less than $-1\times10^{-2}$ (C/kg) and not more than $-5.0\times10^{-2}$ (C/kg). When the triboelectric charge amount of the toner is less than $-1\times10^{-2}$ (C/kg), a developing efficiency is undesirably lowered. When the triboelectric charge amount of the toner exceeds $-5.0\times10^{-2}$ (C/kg), an amount of countercharge generated in the carrier is increased, so that an image quality is undesirably lowered such that a white drop-out level becomes worse.

The triboelectric charge amount of the toner is measured by using an ordinary blow-off method. When 0.5-1.5 g of the toner is subjected to air suction from the developing device to a measuring container, an amount of the electric charge induced in the measuring container is measured to calculate the triboelectric charge amount of the toner. The triboelectric charge amount of the toner can be adjusted depending on the type of a material used and can also be adjusted by addition of an external additive.

As the carrier, a commercially available carrier can be used and a manufacturing method of the carrier is not particularly limited. For example, a resin carrier formed by dispersing magnetite into a resin material and then by dispersing therein carbon black for imparting electroconductivity to the carrier to adjust a resistance can be used. It is also possible to use a carrier obtained by subjecting a surface of a magnetite, such as ferrite, alone to a redox treatment to effect resistance adjustment or a carrier obtained by coating the surface of the magnetite, such as ferrite, alone with a resin material to effect resistance adjustment. A volume resistance of the carrier may preferably be $10^7$ (Ω·cm) or more and $10^{14}$ (Ω·cm) or less in view of leakage or a developing property.

The carrier may preferably have an amount of magnetization of $3.0\times10^4$ (A/m) or more and $2.0\times10^5$ (A/m) or less in the magnetic field of 0.1 tesla. When the magnetization amount of the carrier is less than $3.0\times10^4$ (A/m), it becomes difficult to deposit the developer on a developing sleeve 8 by magnetic flux of a magnet roller 8M (FIG. 2), so that carrier deposition on the photosensitive drum 10 is undesirably liable to occur. When the magnetization amount of the carrier exceeds $2.0\times10^5$ (A/m), a magnetic brush is excessively hardened, so that the toner image formed on the photosensitive drum 10 is undesirably liable to be physically disturbed.

The magnetization amount of the carrier was measured by forming an external magnetic field of 0.1 (T) by using an oscillating magnetic field type magnetic property automatic recording device ("BHV-30", mfd. by Riken Denshi Co., Ltd.) and then by obtaining strength of magnetization at that time. In a state in which a carrier sample is packed sufficiently closely in a cylindrical plastic container, magnetizing moment was measured, and then an actual weight was measured in a state in which the sample is contained in the container, thus obtaining the strength of magnetization ($Am^2$/kg). Then, the true specific gravity of the carrier was obtained by an automatic densitometer of dry type ("Accupyc 1330" mfd. by Shimazu Corp.) and then strength of magnetization per unit volume (A/m) of the carrier was obtained by multiplying the strength of magnetization ($Am^2$/kg) by the true specific gravity.

<Developing Device>

Figure 2:
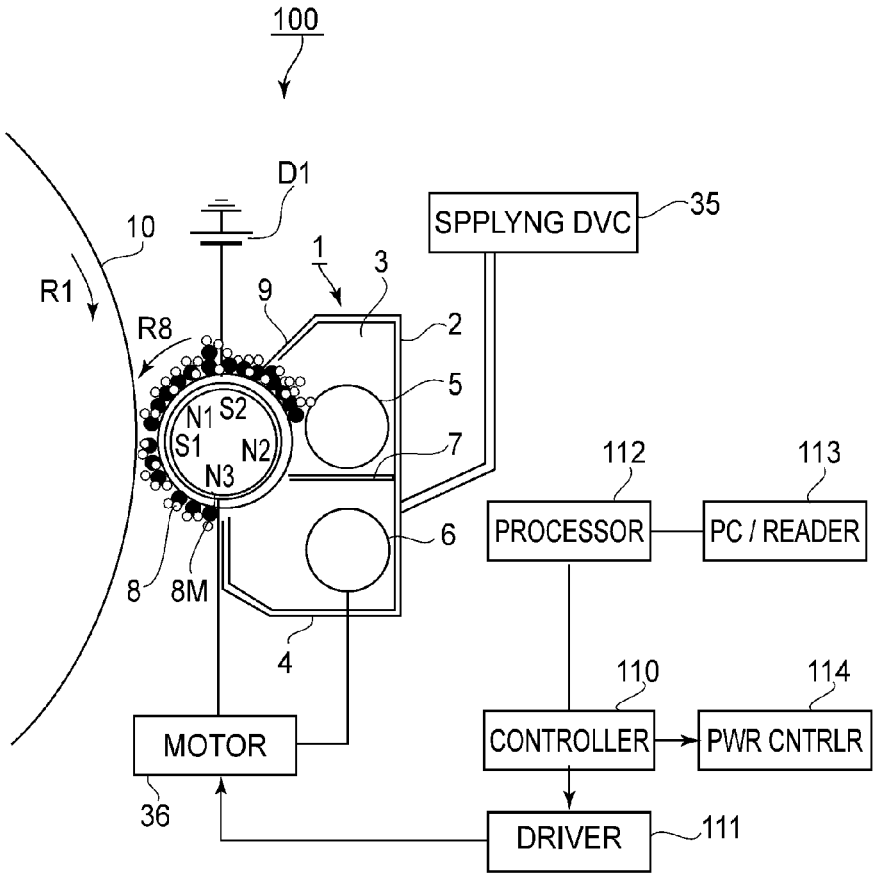
FIG. 2 is an illustration of a structure of a developing device in cross section perpendicular to an axis of the developing device.
Figure 3:
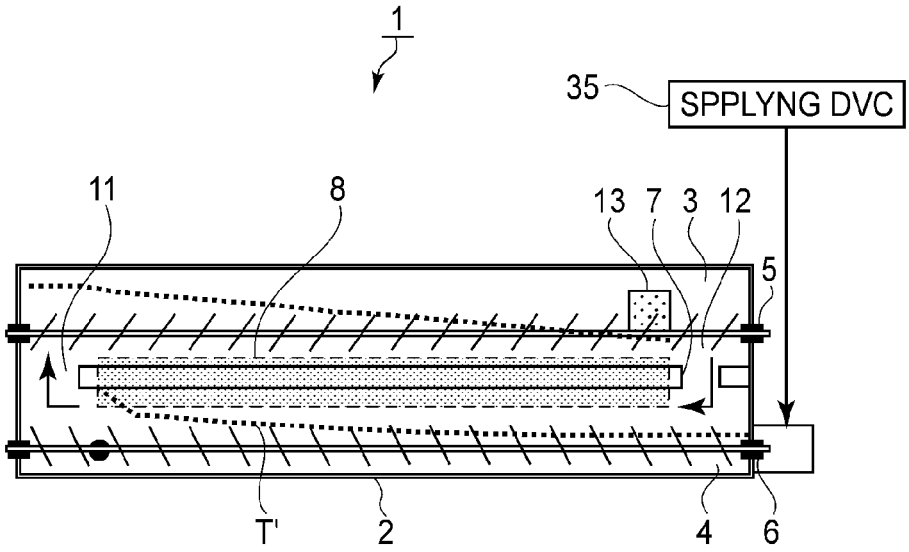
FIG. 3 is an illustration of a structure of the developing device in vertical cross section including an axial direction of the developing device.
Figure 4:
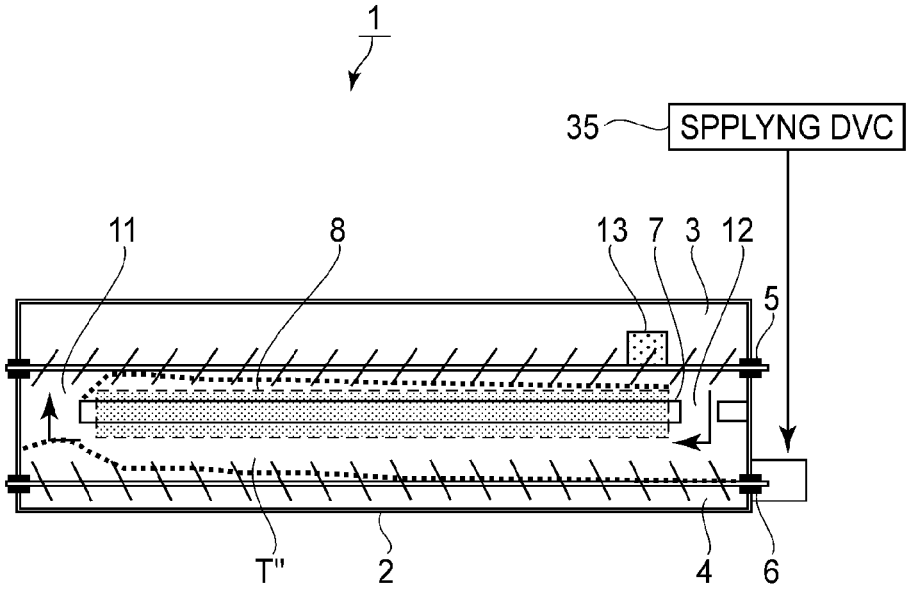
FIG. 4 is an illustration of a developer surface of the developing device in a rest state after an end of development.

FIG. 2 is an illustration of a structure of a developing device in cross section perpendicular to an axis of the developing device. FIG. 3 is an illustration of a structure of the developing device in vertical cross section including an axial direction of the developing device in a steady state during development. FIG. 4 is an illustration of a developer surface of the developing device in a rest state after an end of development.

As shown in FIG. 2, the developing device 1 carries the charged developer on the developing sleeve 8 and rotates the developing sleeve 8 in an arrow R8 direction during development. A power source D1 applies to the developing sleeve 8 an oscillating voltage in the form of a DC voltage Vdc biased with an AC voltage Vac, so that the toner in the developer is transferred onto the electrostatic image on the photosensitive drum 10 to develop the toner image on the photosensitive drum 10.

With the development of the electrostatic image into the toner image, only the toner of the developer is transferred from the developing sleeve 8 onto the photosensitive drum 10, thus being consumed. A developer supplying device 35 supplies a developer for supply, corresponding to the amount of the toner consumed by image formation of the single sheet, every image formation of the single sheet.

The developing sleeve 8 opposes the photosensitive drum 10 at a developing position of the photosensitive drum 10 with a gap of several hundred microns, and is rotatably provided in the developing chamber 2. The developing sleeve 8 is disposed so as to be partly exposed toward the photosensitive drum 10 through an opening of the developing chamber 2. The developing sleeve 8 is formed in a cylindrical shape by using an electroconductive non-magnetic material including metal such as stainless steel or aluminum, a resin material to which electroconductivity is imparted by dispersing therein electroconductive particles, and the like. As a material for the developing sleeve 8, conventionally known various materials can be used.

Inside the developing sleeve 8, the magnet roller 8M as a permanent magnet having an outer peripheral surface where a plurality of magnetic poles are provided is provided in a non-rotational state. The magnetic roller 8M generates magnetic flux between non-rotational magnetic poles disposed inside the rotating developing sleeve 8 to magnetically attract the carrier of the developer to the surface of the developing sleeve 8, thus carrying the developer on the developing sleeve 8. The magnetic roller 8M is not limited to the permanent magnet which always generates the magnetic field, but may also be an electromagnet or the like which is capable of arbitrarily generating a certain magnetic field or magnetic fields different in polarity. The magnet roller 8M has a developing pole S1 disposed at a position opposing the developing position of the photosensitive drum 10 and has other magnetic poles S2, N1, N2 and N3 for feeding the developer at other positions.

A layer thickness regulating blade 9 is provided and fixed on the developing chamber 2 at a position opposing the magnetic pole S2 in an upstream side of the photosensitive drum 10 with respect to a rotational direction of the developing sleeve 8. The layer thickness regulating blade 9 is formed in a plate-like shape by using a non-magnetic material such as aluminum so that its end opposes the developing sleeve 8 with a gap of about several hundred microns.

The layer thickness regulating blade 9 cuts a chain of the developer carried on the rotating developing sleeve 8 in an erected state in a predetermined thickness, thus regulating the developer layer thickness. By adjusting the gap between the layer thickness regulating blade 9 and the developing sleeve 8, an amount of the developer fed to the developing position while being carried on the developing sleeve 8 is set.

The developer having passed through the gap between the end of the layer thickness regulating blade 9 and the developing sleeve 8 is fed to the developing position of the photosensitive drum 10 to be placed in an erected state in response to the developing pole S1 to form a magnetic chain of the developer. In a state in which the end of the magnetic chain slides on the photosensitive drum 10, the electrostatic image on the photosensitive drum 10 is developed into the toner image. At this time, in order to improve the developing efficiency (i.e., a toner imparting ratio to the electrostatic image), the above-described oscillating voltage is applied to the developing sleeve 8.

A partition wall 7 is provided at an intermediate position of the inside of the developing chamber 2 with respect to a height direction and is extended in a direction perpendicular to the drawing sheet surface to partition a space into an upper developing chamber 3 and a lower stirring chamber 4. In the developing chamber 3, a developing screw 5 is provided, and in the stirring chamber 4, a stirring screw 6 is provided. The developer is fed while being stirred by the developing screw 5 and the stirring screw 6 to be circulated in the developing chamber 2.

As a feature of the vertical stirring type developing device 1, the developer in the developing chamber 3 is gradually supplied to the developing sleeve 8 while being fed by the developing screw 5. The layer thickness of the developer carried on the developing sleeve 8 is regulated by the layer thickness regulating blade 9, and the developer is fed to an opposing portion to the photosensitive drum 10 to develop the electrostatic image on the photosensitive drum 10 into the toner image. Thereafter, the developer separated from the developing sleeve 8 between the magnetic poles N2 and N3 of the magnetic roller 8M flows into the stirring chamber 4, thus being mixed with the developer circulated by the stirring screw 6.

The developer, after the development, rich in carrier by subjecting the toner to development of the electrostatic image is collected in the stirring chamber 4 side, not in the developing chamber 3 side, with the rotation of the developing sleeve 8. For this reason, in the developing sleeve 8, only the developer which is always stirred in the stirring chamber 4 and has a predetermined toner content (concentration) is present. For this reason, the developer which is always uniform and constant in toner content is supplied to the developing sleeve 8, so that a uniform image free from image non-uniformity and a density difference with respect to a rotational axis direction can be obtained.

As shown in FIG. 3, the developer supplying device 35 supplies a developer for supply to an upstream side of the stirring chamber 4 through an unshown supply opening. The developer for supply is constituted by 90% of the toner and 10% of the carrier in weight ratio. The developer is fed in opposite directions in the developing chamber 3 and the stirring chamber 4 by rotations of the developing screw 5 and the stirring screw 6, and then is transferred through openings 11 and 12, thus being circulated in the developing chamber 2.

At tone end of the partition wall 7, the opening 11 is provided, and at another end of the partition wall 7, the opening 12 is provided. The developing chamber 3 and the stirring chamber 4 communicate with each other through the openings 11 and 12 with respect to the height direction. The developing screw 5 is provided with a spiral blade member of a non-magnetic material around a rotation shaft constituted by a ferromagnetic member. The stirring screw 6 is, similarly as in the case of the developing screw 5, provided with a blade member around a rotation shaft but a helical direction of the blade member thereof is opposite to that of the developing screw 5.

The developing screw 5 is disposed in parallel to the developing sleeve 8 along the partition wall 7 constituting the bottom of the developing chamber 3. The developing screw 5 is rotated to feed the developer in the developing chamber 3 toward the opening 12 in the axial direction and drops the developer through the opening 12 to deliver the developer to the stirring chamber 4. The developing screw 5 supplies a part of the developer while feeding the developer delivered from the stirring chamber 4 in a circulation direction.

The stirring screw 6 is disposed in parallel to the developing screw 5 along the bottom surface of the developing chamber 2 constituting the bottom of the stirring chamber 4. The stirring screw 6 is rotated to feed the developer in the stirring chamber 4 toward the opening 11 in the axial direction and pushes up the developer through the opening 11 to deliver the developer to the developing chamber 3. The developer is pushed up from below to above by pressure of the developer which is fed by the stirring screw 6 and is stagnated below the opening 11, so that the developer is delivered from the stirring chamber 4 to the developing chamber 3.

The stirring screw 6 stirs and feeds the developer delivered from the developing chamber 3 via the opening 12, the developer separated from the developing sleeve 8 after the development, and the developer for supply supplied from the developer supplying device 35 to uniformize the toner content of the developer.

<Excess of Developer>

As the developing device advantageous to downsize the image forming apparatus, the vertical stirring type developing device in which the developing chamber and the stirring chamber are superposedly disposed with respect to the height (vertical) direction has been put into practical use. In the vertical stirring type developing device 1, the developer which is used for the development on the developing sleeve 8 to be lowered in toner content is collected exclusively by the stirring chamber 4, and is sufficiently mixed with the developer for supply to restore its toner content and then is returned to the developing chamber 3, so that the developer is carried again on the developing sleeve 8 to be used for the development. For that reason, the toner content of the developer carried on the developing sleeve 8 is ensured at a constant level with respect to the rotational axis direction, so that image density non-uniformity due to a variation in toner content does not occur and therefore the developing device 1 contributes to also an improvement in image quality of an output image.

In recent years, the image forming apparatus is, in order to meet POD (print on demand) use, required to reduce a time from reception of an image forming job to output of a print, i.e., a so-called first copy time, in addition to high-speed printing performance. For that reason, in the vertical stirring type developing device 1, the development of the electrostatic image into the toner image is started after a start of a rotation operation of the developing device 1 and before the developer in the developing chamber 2 reaches its steady state. Then, in the case of a short-time image forming job such as a one-sheet print job, the developing device 1 is stopped before the developer in the developing chamber 2 reaches its steady state.

As shown in FIG. 3, in the vertical stirring type developing device 1, when a space under the opening 11 is sufficiently filled with the developer fed toward the downstream side in the stirring chamber 4 by the stirring screw 6, the developer is pushed out to the developing chamber 3, so that the developer is fed toward the downstream side in the developing chamber 3 by the developing screw 5. The developing device 1 circulates the developer against the gravitation and therefore a surface (level) of the developer in the developing chamber 2 of the developing device 1 in operation has a slope as indicated by T'. However, when the developing device 1 is stopped, the developer pushed up into the developing chamber 3 by the stirring screw 6 drops into the stirring chamber 4 and at the same time, the developer raised by the developing screw 5 and the stirring screw 6 is not raised. For this reason, when the developing device 1 is stopped, the developer surface T' in the developing chamber 3 and the stirring chamber 4 is lowered as a whole as shown in FIG. 4.

As shown in FIG. 4, when the image forming job is started from a state in which the developing device 1 is stopped, the developer surface becomes the developer surface T' in the steady state in about 2.5 sec as shown in FIG. 3, and the electrostatic image is developed into the toner image while maintaining the state of the developer surface T'. In this case, when the developer for supply containing 10% of the carrier is supplied from the developer supplying device 35, the developer surface T' is somewhat raised, so that the developer overflows through a developer discharge opening 13 provided at a downstream portion of the developing screw 5. The developer at a level higher than a level of a level-off state is discharged to the outside of the developing chamber 2 through the developer discharge opening 13, so that an amount of the developer in the developing chamber 2 is regulated at a proper amount.

However, in an image forming job with a small print number, rotation times of the developing sleeve 8, the developing screw 5 and the stirring screw 6 are short, so that the image forming job is ended in some cases while a developer surface T" shown in FIG. 4 does not reach the developer surface T' shown in FIG. 3. In these cases, even when the developer for supply is supplied from the developer supplying device 35, the developer does not overflow through the developer discharge opening 13, with the result that the amount of the developer in the developing chamber 2 exceeds the proper amount.

For this reason, when the image forming job in which the print number is one is repeated again and again, the developer in the developing chamber 2 is continuously increased in amount while being not discharged at all through the developer discharge opening 13. As a result, the space in the downstream side of the stirring chamber 4 is filled with an excessive developer, so that the developer after the development cannot be satisfactorily collected from the developing sleeve 8 in some cases.

<Comparative Embodiment>

Parts (a) and (b) of FIG. 5 are illustrations of operations in post-rotation modes in Comparative Embodiment, wherein (a) of FIG. 5 shows a one-sheet print job, and (b) of FIG. 5 shows a two-sheet print job. FIG. 6 is a graph showing a change in developer surface in a developing chamber after actuation.

As shown in FIG. 2, in Comparative Embodiment, a peripheral speed of the photosensitive drum 10 is 350 mm/sec, and a sheet passing interval is 100 mm/sec. The developing sleeve 8, the developing screw 5 and the stirring screw 6 are connected by a gear train and are integrally rotated by a development driving motor 36.

As shown in (a) of FIG. 5 with reference to FIG. 1, a job from a start of a pre-rotation operation to an end of a post-rotation operation through an image forming operation is defined as one image forming job (print job). Further, an operation in which the electrostatic image is written (formed) on the photosensitive drum 10 by the exposure device 22 and then is visualized as the toner image by the developer carried on the developing sleeve 8 is defined as the image forming operation.

In the case where an image is printed on a single A4-sized sheet fed in a long edge feeding manner, the pre-rotation operation is performed as a preparatory operation for forming the image on the photosensitive drum 10. In the pre-rotation operation, subsequently to the photosensitive drum 10, rotations of the developing sleeve 8, the developing screw 5 and the stirring screw 6 are started (actuated). Then, voltages to be applied to the corona charger 21 and the developing sleeve 8 are raised and stabilized, so that this operation is an operation in a pre-rotation mode for creating a state in which the toner image is formable on the photosensitive drum 10 if only the exposure operation is started.

The pre-rotation operation is performed for 1 sec in total in Comparative Embodiment, in which the developing sleeve 8 is rotated for 0.5 sec. When a rotational speed of the developing sleeve 8 is not stabilized, image non-uniformity occurs and therefore as the preparatory operation, drive of the developing sleeve 8 is started before the image forming operation by 0.5 sec.

After the pre-rotation operation, the image forming operation is executed. In the image forming operation, exposure is turned on for 0.6 sec corresponding to a length of the A4-size sheet fed in the long edge feeding manner, and then is turned off. During the image forming operation, the developing sleeve 8, the developing screw 5 and the stirring screw 6 are continuously rotated to continuously visualize the electrostatic image formed on the photosensitive drum 10.

After the end of the image forming operation, the post-rotation operation for stopping the photosensitive drum 10 and the developing device 1 is performed. The post-rotation operation is performed in a post-rotation mode in which various driving systems and high-voltage sources which are turned on (actuated) in the pre-rotation operation are stopped. The photosensitive drum 10 is finally stopped so that an unnecessary trace of voltage change is not formed on the photosensitive drum 10. In order not to form an unnecessary toner image on the photosensitive drum 10, the voltage applied to the developing sleeve 8 is turned off until the position where charging of the photosensitive drum 10 is turned off reaches the developing sleeve 8.

As a result, in the one-sheet print job of the A4-sized sheet fed in the long edge feeding manner in Comparative Embodiment, the developing sleeve 8 is rotated only for 1.1 sec. Further, throughout a period in which the developing sleeve 8 is rotated, the developing screw 5 and the stirring screw 6 are continuously rotated, and the voltage is continuously applied to the developing sleeve 8.

As shown in (b) of FIG. 5 with reference to FIG. 1, in the case of the two-sheet print job, the image forming time is twice that in the one-sheet print job, and a sheet interval (image interval) is added. As a result, even in the two-sheet print job of the A4-sized sheet fed in the long edge feeding manner, the developing sleeve 8 is rotated only for 1.8 sec as follows.

$$0.5\ (\text{sec})+0.6\ (\text{sec})+0.1\ (\text{sec})+0.6\ (\text{sec})=1.8\ (\text{sec})$$

As shown in FIG. 6, until 2.5 sec after actuation of the developing device 1, the developer surface (level) below the developer discharge opening 13 is continuously raised and then is stabilized at the developer surface T' in the steady state when the elapsed time from the actuation of the developing device 1 exceeds 2.5 sec.

For this reason, even in either of the one-sheet print job and the two-sheet print job, the developing device 1 is stopped before the developer surface below the developer discharge opening 13 reaches the height of a lower end of the developer portion 13 and the developer in an amount corresponding to the amount of the supplied developer for supply is caused to overflow. As a result, the developer in the developing chamber 2 is increased in amount more than that before the start of the job.

On the other hand, if the print job is a three-sheet print job, the drive time of the developing device 1 is 2.4 sec by a similar calculation, and therefore it would be considered that the developer surface below the developer discharge opening 13 exceeds the height of the lower end of the developer discharge opening 13 to overflow. Therefore, in the operation in the post-rotation mode in Comparative Embodiment, unless the print job is a print job of three or more sheets, the developer surface in the developing chamber 2 does not reach the developer surface in the steady state, so that the amount of the developer in the developing chamber 2 becomes larger than that before the start of the job. When the print job in which the drive time of the developing device 1 is within 2.5 sec, i.e., the print job of two sheets or less is repeated, discharge of the developer through the developer discharge opening 13 is not satisfactorily effected, so that the amount of the developer in the developing chamber 2 is increased more than expected.

When the developer in the developing chamber 2 is increased in amount, an overload of the development driving motor 36 is generated, and therefore there is a need to mount, for the developing device 1, a motor with considerable allowance in advance. As a result, problems such as a size, a manufacturing cost and temperature rise of the developing device 1 occurs.

Therefore, by making reference to JP-A 2009-192554, a constitution in which a developer surface (level) detecting sensor is provided at a position of the discharge opening 13 and the developing device 1 is stopped after checking that the developer surface reaches the height of the lower end of the discharge opening 13 was proposed. However, the developer surface of the developer fed in the first chamber 3 is fluctuated and therefore stop timing of the developing device 1 is undesirably fluctuated largely toward before and after intended timing. Also the provision of the developer surface detecting sensor and a variable rotation speed of the second screw member 6 undesirably cause an increase in cost of the developing device 1 and undesirably constitute hindrance to downsizing of the developing device 1.

When a developer surface sensor is provided in the developing chamber 3 and discharge of excessive developer through the developer discharge opening 13 is intended to be controlled, problems of a disposing space and disposing cost of the developer surface sensor occurs.

Therefore, in the following embodiments, by incorporating an adjusting program of the developer into the post-rotation operation of the developing device 1, the increase in amount of the developer in the developing chamber 2 is prevented without requiring an unnecessary output motor and an unnecessary developer surface detecting sensor.

<Embodiment 1>

FIG. 7 is a flow chart of an operation in a post-rotation mode in Embodiment 1. In this embodiment, the drive time of the developing device 1 of 2.5 sec or more in total is ensured even in the one-sheet print job by using the post-rotation operation time in the constitution and control in Comparative Embodiment, so that the excessive developer is caused to overflow with reliability.

As shown in FIG. 2, the developing sleeve 8 as an example of the developer carrying member carries the developer containing the toner and the carrier and develops the electrostatic image on the photosensitive drum 10. The stirring chamber 4 as an example of the second chamber communicates with the developing chamber 3 as an example of the first chamber at its end portions to form a communication path, and transfers the developer between itself and the developing chamber 3 with respect to the height direction.

The developing screw 5 as an example of the first screw member is disposed in the developing chamber 3 and supplies the developer to the developing sleeve 8 while feeding the developer. The stirring screw 6 as an example of the second screw member is disposed in the stirring chamber 4 and mixes the developer with the developer collected from the developing sleeve 8 while feeding the developer. The developer supplying device 35 as an example of the supplying portion supplies, in order to supply the toner in an amount corresponding to that of the toner consumed by the image formation, the developer for supply containing the toner and the carrier to the developer communication path. The developer discharge opening as an example of the discharging portion, in the downstream side of the developing chamber 3 as an example of the first chamber in the downstream side, the excessive developer is caused to overflow.

The controller 110 as an example of the control means executes the operation in the post-rotation mode after the electrostatic image is developed by using the developing sleeve 8, thus stopping the developing sleeve 8, the developing screw 5 and the stirring screw 6. The controller 110 controls, when a first time from the rotation start of the developing screw 5 to the end of the development of the electrostatic image is less than a predetermined time, a second time from the end of the development of the electrostatic image to the stop of the developing screw 5 so as to be longer than that when the first time is not less than the predetermined time.

The controller 110 controls the second time (from the end of the development of the electrostatic image to the stop of the developing screw 5) so as to be longer with an increasing excessive amount of the developer in the developing device at the time of the end of the development of the electrostatic image. The controller 110 controls the second time so as be longer with a decreasing first time (from the rotation start of the developing screw 5 to the end of the development of the electrostatic image).

As shown in FIG. 7 with reference to FIG. 2, the controller 110 starts preparation of an image forming job when an image information processing portion 112 receives the image forming job from an input device (PC, reader or the like) 113 (S11). The controller 110 turns on various driving motors and high-voltage power circuits through a drive controller 111 and a power source controller 114 (S12).

The controller 110 starts, concurrently with turning-on of rotation drive of the developing device 1, counting of a developing device drive time (rotation drive time of the developing device 1) (S13). The controller 110 starts exposure by the exposure device 22 (FIG. 1) through the drive controller 111 to perform an image forming operation (S14).

The controller 110 outputs an image forming operation end signal to the drive controller 111 and the power source controller 114 when all of image signals are completely sent from the image information processing portion 112 (S15). As a result, the drive controller 111 and the power source controller 114 start a post-rotation operation at timing when a developing operation at a trailing end of an image on the photosensitive drum 10 is ended (S16).

The controller 110 discriminates whether or not the rotation drive time of the developing device 1 in the ended image forming job is 2.4 sec or more (S17).

The controller 110 immediately stops the rotation drive of the developing device 1 as shown by a solid line in (a) of FIG. 5 in the case where the rotation drive time of the developing device 1 is 2.5 sec or more (YES of S17), and then ends the post-rotation operation and thus the sequence goes to a job end (S19).

That is, the controller controls, on the basis of a first drive time from a start of the counting of the rotation drive time of the developing device 1 to the end of the developing operation at the trailing end of the image on the photosensitive drum 10, a second drive time from the end of the developing operation to the stop of the rotation drive of the developing device 1.

The controller 110 continues, when the rotation drive time of the developing device 1 is less than 2.5 sec (NO of S17), the rotation drive of the developing device 1 in the post-rotation operation as shown by a broken line in (b) of FIG. 5. The rotation drive of the developing device 1 is continued until an elapsed time from the start of the counting of the rotation drive time of the developing device 1 reaches 2.5 sec in total, and then the post-rotation is ended and thereafter the sequence goes to the job end (S19). As a result, a main assembly operation is completely stopped to end the job.

<Embodiment 2>

FIG. 8 is an illustration of a structure of a developing device in Embodiment 2. Parts (a) and (b) of FIG. 9 are time charts of operations in post-rotation modes in Embodiments 1 and 2, respectively. FIG. 10 is a graph showing a change in developer surface after a developing sleeve is stopped. FIG. 11 is a graph for illustrating a necessary additive time of a developing screw and a stopping screw. FIG. 12 is a flow chart of an operation in a post-rotation mode in Embodiment 2.

In this embodiment, independently of the developing device driving motor 36 for driving the developing sleeve 8, a stirring device driving motor 37 for driving the developing screw 5 and the stirring screw 6 was provided. Other constitutions are the same as those of Embodiment 1 and therefore in FIG. 8, constituent members or portions common to Embodiments 1 and 2 are represented by the same reference numerals or symbols as in FIG. 2 and will be omitted from redundant description.

In the operation in the post-rotation mode in Embodiment 1, the excessive developer is discharged through the developer discharge opening 13 by effecting the rotation drive of the developing device 1, but a frictional deterioration of the developer is advanced correspondingly to an extended rotation drive time. Therefore, in this embodiment, by stopping the developing sleeve 8 and by rotating the developing screw 5 and the stirring screw 6, a discharging speed of the developer through the developer discharge opening 13 was increased. By stopping the developing sleeve 8, the frictional deterioration of the developer generated in the upstream side of the layer thickness regulating blade 9.

In the case where the developing sleeve 8 and the developing and stirring screws 5 and 6 are driven in interrelation with each other as shown in FIG. 2, drive and stop timing of the developing sleeve 8 and that of the developing and stirring screws 5 and 6 are the same as shown in (a) of FIG. 9.

In the case where the developing sleeve 8 and the developing and stirring screws 5 and 6 are driven separately from each other as shown in FIG. 8, after the developing sleeve 8 is stopped, the developing and stirring screws 5 and 6 are continuously rotated as shown in (b) of FIG. 9.

The controller 110 stops, when a time from the rotation start of the developing screw 5 to the end of the development of the electrostatic image is not less than a predetermined time, the rotation of the developing screw 5 until the rotation of the developing sleeve 8 is stopped. However, the controller 110 stops, when the time is less than the predetermined time, the rotation of the developing sleeve 8 before the rotation of the developing screw 5 is stopped. In a state in which the rotation of the developing sleeve 8 is stopped, the rotation of the developing screw 5 is continued, so that the developer is caused to overflow through the developer discharge opening 13.

That is, in this embodiment, with respect to the drive stop timing of the developing sleeve 8, the drive of the developing sleeve 8 is stopped at predetermined timing depending on developing operation end timing. On the other hand, the drive stop timing of the developing screw 5 is changed depending on the time from the rotation start of the developing screw 5 to the end of the development of the electrostatic image (first drive time).

As shown in (b) of FIG. 9, the controller 110 stops the developing and stirring screws 5 and 6 somewhat later than the developing sleeve 8 to intentionally destroy a circulation balance of the developer, so that the developer surface is placed in its steady state in a time shorter than that in Embodiment 1.

The developer raised from the stirring chamber 4 to the developing chamber 3 by the stirring screw 6 is decreased in amount of flow by by-passing the developing chamber 3 to be moved to the stirring chamber 4 by the developing sleeve 8 in a process of feeding the developer in the developing chamber 3 toward the developer discharge opening 13 by the developing screw 5. For this reason, in the post-rotation operation, when the rotation drive of the developing sleeve 8 is stopped in advance of the stop of the rotation drive of the screws 5 and 6, the by-pass movement of the developer by the developing sleeve 8 is eliminated and correspondingly the developer surface in the developing chamber 3 is quickly raised more than the case where the developing sleeve 8 is rotationally driven.

As shown in FIG. 10, in this embodiment in which the developing sleeve 8 is stopped prior to the screws 5 and 6, as indicated by broken lines, a developer surface rising speed is faster than that in Embodiment 1 indicated by a solid line. With earlier timing of the stop of the developing sleeve 8, timing when the developer surface (level) reaches the developer surface T' where the discharge of the excessive developer through the developer discharge opening 13 starts becomes earlier, so that a time of stirring of the developer in the developing chamber 2 can be shortened until the discharge of the excessive developer is ended.

In Embodiment 1, 2.5 sec is required until the developer surface reaches the developer surface T' where the discharge of the developer through the developer discharge opening 13 starts. However, in this embodiment, in the case where the developing sleeve 8 is stopped in 0.5 sec, the developer surface reaches the developer surface T' in only 1.5 sec in total, so that the developer is discharged through the developer discharge opening 13.

Incidentally, when the rotation of the developing sleeve 8 is stopped and then the developing screw 5 and the stirring screw 6 are continuously rotated, the developer surface is quickly raised to rapidly discharge the developer through the developer discharge opening 13, so that the remaining developer amount is below a proper developer amount in the developing chamber 2. For that reason, there is a need to prevent the developer from being excessively discharged through the developer discharge opening 13 by accurately effecting control of timing when the developing screw 5 and the stirring screw 6 are stopped.

As shown in FIG. 11, the timing when the developing screw 5 and the stirring screw 6 are stopped is each of times from respective stop times of the developing sleeve 8 in FIG. 10 until associated developer surfaces reach the developer surface T'. In FIG. 11, the abscissa represents the rotation drive time of the developing device 1 until the development is ended in one image forming job. When a time x from actuation of the developing device 1 until the developing sleeve 8 is stopped in the one image forming job reaches 2.5 sec, as described in Embodiment 1, there is no need to continuously rotate the developing screw 5 and the stirring screw 6 after the stopping the developing sleeve 8. From the graph of FIG. 11, an approximate expression (1) shown below is obtained, so that a time y for which the developing screw 5 and the stirring screw 6 are driven can be accurately derived on the basis of the time x from the actuation of the developing device 1 until the developing sleeve 8 is stopped.

$$y=-0.37x+0.925 \quad (1)$$

As shown in FIG. 12 with reference to FIG. 8, the controller 110 starts preparation of an image forming job when an image information processing portion 112 receives the image forming job from the input device 113 (S21). The controller 110 turns on various driving motors and high-voltage power circuits through a drive controller 111 and a power source controller 114 (S22).

The controller 110 starts, concurrently with turning-on of rotation drive of the developing device 1, counting of the rotation drive time of the developing device 1 (S23). The controller 110 starts exposure subsequently to the pre-rotation operation, thus performing an image forming operation (S24).

The controller 110 outputs an image forming operation end signal at timing of an end of exposure for a final image (S25), and then the post-rotation operation is started (S26).

The controller 110 ordinarily ends, when the rotation drive time of the developing device 1 is 2.5 sec or more (YES of S27), the post-rotation operation and then the sequence goes to a job end (S31).

The controller 100 stops, when the rotation drive time of the developing device 1 is less than 2.5 sec (NO of S27), the rotation of the developing sleeve (S28).

The controller 100 continues the rotations of the developing screw 5 and the stirring screw 6 until the time y obtained from the expression (1) described above is elapsed from the stop of the developing sleeve 8 (S29).

The controller 100 stops the rotations of the developing screw 5 and the stirring screw 6 (S30), and then the sequence goes to the job end (S31).

<Embodiment 3>

FIG. 13 is a flow chart of an operation in the post-rotation mode in Embodiment 3. In Embodiment 1, the rotation drive time of the developing device was evaluated every one image forming job, and then the excessive developer was discharged during the post-rotation operation. In this case, when the one-sheet print job is repeated many times with a slight stop time (sheet interval), a long post-rotation operation time is conspicuous, so that sensuous productivity is lowered.

Therefore, in Embodiment 3, the post-rotation time is controlled depending on a history of the image forming job. That is, the post-rotation time is controlled on the basis of a developing device drive time, in the last job or earlier job, from the rotation start of the developing screw 5 to the end of the development of the electrostatic image, and the developing device drive time in a current job. Specifically, in the constitution in Embodiment 1 shown in FIG. 2, the post-rotation operation time is not extended every one image forming job but is extended collectively at once in the case where an image forming job in which the rotation drive time of the developing device is insufficient is performed predetermined times. A counter for counting the number C of instances where the developing device operation time is less than 2.5 sec ("less-than-2.5-developing device drive time number C") is provided, and counts the number of continuous instances of an image forming job in which the rotation drive time of the developing device 1 is less than 2.5 sec. Even when the number of continuous instances of the image forming job reaches 10, the post-rotation operation time is extended once until the rotation drive time of the developing device 1 reaches 2.5 sec.

As shown in FIG. 2, the controller 110 as an example of the control means executes the operation in the post-rotation mode after the electrostatic image is developed by using the developing sleeve 8, thus stopping the developing screw 5 and the stirring screw 6. The controller 110 controls, when image formation in which a first time from the rotation start of the developing screw 5 to the end of the development of the electrostatic image is less than a predetermined time is continuously repeated predetermined times, a second time from the end of the development of the electrostatic image to the stop of the developing screw 5 so as to be longer than that when the first time is not less than the predetermined time.

As shown in FIG. 13 with reference to FIG. 2, the controller 110 starts preparation of an image forming job when an image information processing portion 112 receives the image forming job from the input device 113 (S41). The controller 110 turns on various driving motors and high-voltage power circuits through a drive controller 111 and a power source controller 114 (S42).

The controller 110 starts, concurrently with turning-on of rotation drive of the developing device 1, counting of the rotation drive time of the developing device 1 (S43). The controller 110 starts exposure subsequently to the pre-rotation operation, thus performing an image forming operation (S44).

The controller 110 outputs an image forming operation end signal at timing of an end of exposure for a final image (S45), and then the post-rotation operation is started (S46).

The controller 110 ordinarily ends, when the rotation drive time of the developing device 1 is 2.5 sec or more (YES of S47), the post-rotation operation and resets the counter of the less-than-2.5-developing device drive time number C to zero (S51), and then the sequence goes to a job end (S52).

The controller 100 increments, when the rotation drive time of the developing device 1 is less than 2.5 sec (NO of S47), the count of the less-than-2.5-developing device drive time number C by (S48).

The controller 100 extends, when the less-than-2.5-developing device drive time number C is accumulated to reach 10 (YES of S49), the rotation drive time of the developing device 1 in the post-rotation operation as indicated by a broken line in (a) of FIG. 5. The rotation drive of the developing device 1 is continued until the rotation drive time of the developing device 1 from the start of the pre-rotation operation reaches 2.5 sec, and thereafter the rotation drive of the developing device 1 is stopped (S50). Then, the counter is reset to zero (S51), and thereafter the sequence goes to a job end (S52).

The controller 110 stops, when the less-than-2.5-developing device drive time number C is less than 10 (NO of S49), the rotation drive of the developing device 1 as indicated by a solid line in (a) of FIG. 5 and then the sequence goes to the job end (S52).

In the operation in the post-rotation mode in this embodiment, only when the image forming job in which the rotation drive time is insufficient is continued 10 times, in the post-rotation operation, as shown in FIG. 3, circulation of the developer is returned to the steady state and then the excessive developer is discharged through the developer discharge opening 13. For this reason, the post-rotation operation time is not extended until the number of instances of the image forming job reaches 10 times, so that the post-rotation operation time is prevented from becoming conspicuous as being long.

Further, when an image forming job in which the rotation drive time of the developing device 1 is sufficient is inputted even one time until the number of instances of the image forming job in which the rotation drive time of the developing device 1 is insufficient reaches 10 times, at that time, the excessive developer in the developing device 1 is discharged through the developer discharge opening 13, so that the excessive developer state is eliminated.

For this reason, the counter indicating 10 (times) is reset to zero, so that the number of instances of the rotation drive of the developing device 1 to be continued in the post-rotation operation may only be required to be further small.

However, the post-rotation time from the end of the development of the electrostatic image to the stop of the developing screw 5 may desirably be longer than a time obtained by subtracting the time, from the rotation start of the developing screw 5 to the end of the development of the electrostatic image, from a predetermined time. There is a limit on a speed at which the developer is discharged from the developer portion 13 and therefore in the case where the amount of the excessive developer is large, the excessive developer state cannot be eliminated in some instances only by increasing the rotation drive time of the developing device 1 to 2.5 sec. For example, in the case where a threshold of the less-than-2.5-developing device drive time number C is 20, a total amount of the developer to be discharged from the developer discharge opening 13 becomes large and therefore it is desirable that the rotation drive time of the developing device 1 is extended to 2.9 sec.

In this embodiment, even when the rotation drive time is extended, after the developer state reaches the steady state shown in FIG. 3 and the excessive developer is discharged, there is no developer discharged from the developer discharge opening 13 and therefore the amount of the developer in the developing chamber 2 is not below the proper amount. For this reason, the rotation drive time of the developing device 1 can be set at a fixed value.

However, in the case where control in which the developing sleeve 8 is stopped prior to the screws is effected by following the operation in the post-rotation mode in Embodiment 2, even after the developer surface in the developing chamber 3 reaches the lower end of the developer discharge opening 13, the developer is rapidly discharged through the developer discharge opening 13. For this reason, it is desirable that the excessive amount of the developer is properly estimated to variably set the rotation drive time of the developing device 1.

In this embodiment, in the case where the image forming job in which the developing device rotation drive time is insufficient is performed predetermined times, the rotation drive time extension control is effected but the number of instances of the image forming job is not limited to the predetermined times. It is also possible to change the predetermined times depending on a history of the image forming job in which the developing device rotation drive time is insufficient. For example, a necessary post-rotation time is different between during the one-sheet print job and during the two-sheet print job. For this reason, it is also possible to employ a constitution in which the post-rotation time is extended at predetermined timing depending on the history of each print job.

Further, the amount of the developer in the developing device fluctuates depending on a print ratio and therefore the extension timing of the post-rotation time may also be changed depending on the print ratio. For example, in the case where the print ratio is higher than a predetermined print ratio, the developer amount is increased. Further, in the case where the print ratio is lower than the predetermined print ratio, the developer amount is decreased. For this reason, in the above case, compared with another case, a frequency of the post-rotation time extension may be controlled so as to be increased.

<Embodiment 4>

In Embodiments 1 to 3, in the case where the rotation drive time of the developing device 1 in one image forming job is shorter than a necessary time required to increase the developer surface (level) from T" (FIG. 4) to T' (FIG. 3), the post-rotation time of the developing device 1 is made longer than the ordinary post-rotation time of the developing device 1. However, the necessary time required to increase the developer surface from T" (FIG. 4) to T' (FIG. 3) varies depending on flowability of the developer and therefore there is the case where the fixed post-rotation time of 2.5 sec as in Embodiment 1 is insufficient.

Therefore, in Embodiment 4, the post-rotation time of 2.5 sec in the flow chart of FIG. 7 is adjusted depending on a parameter with respect to the flowability of the developer. A "predetermined time" is set at a longer time with an increasing cumulative use time of the developer, an increasing temperature of the developer circulation path, or an increasing absolute humidity of the developer circulation path. When the developer is in a state in which the flowability of the developer is low and thus a developer discharging property from the developer discharge opening 13 is poor, 2.5 sec is extended to 3.0 sec or 4.0 sec appropriately.

In this embodiment, as the parameter for evaluating the flowability of the developer, during a long-term use of the developer, ambient temperature rise of the developing device 1 and a degree of high humidity of the developing device 1 are evaluated. The constitution in Embodiment 1 is effected by setting the post-rotation time of the developing device 1 at a longer time with a longer cumulative use time of the developer, a higher ambient temperature of the developing device 1, or a higher ambient humidity of the developing device 1.

<Embodiment 5>

In Embodiments 1 to 3, the rotation drive time was measured by using a timer, but in Embodiment 5, the rotation drive time of the developing device 1 is estimated from a print sheet size and the number of sheets subjected to a job. In this embodiment, even when there is no information on the sheet size, in the case of an image forming apparatus in which the sheet size is limited, the rotation drive time of the developing device 1 is calculated from only the print job sheet number and can be compared with 2.5 sec.

In this embodiment, information on a drive time for which the developing screw 5 is driven from a start of the pre-rotation operation in one image forming job to an end of the developing step is obtained to estimate the rotation drive time of the developing device 1. The rotation drive time is calculated by using a sheet number counter for detecting the number of sheets subjected to image formation, a rotation number counter for the developing sleeve 8, a rotation number counter for the developing screw, or the like counter.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 005344/2012 filed Jan. 13, 2012, which is hereby incorporated by reference.

What is claimed is:

1. An image forming apparatus comprising:

an image bearing member on which an electrostatic image is to be formed;

a developer carrying member for carrying a developer including a toner and a carrier to develop the electrostatic image on said image bearing member;

a first chamber for permitting feeding of the developer to said developer carrying member;

a second chamber, provided at a position different in height from said first chamber, for forming a circulation path of the developer by communicating with said first chamber at end portions thereof, wherein said second chamber collects the developer from said developer carrying member at an opposing position to said developer carrying member;

a first screw member for feeding the developer contained in said first chamber;

a second screw member for feeding the developer contained in said second chamber;

a supplying portion for supplying a developer including a toner and a carrier to compensate for the toner consumed by image formation;

a discharging portion, provided in the circulation path, for causing an excessive developer to overflow; and a controller for for effecting control so that when a first drive time from a start of rotation of said first screw member to an end of an image forming operation of a final image in a print job is shorter than a predetermined time, compared with when the first drive time is longer than the predetermined time, a second drive time from the end of the image forming operation of the final image in the print job to a stop of the rotation of said first screw member is longer during the print job.

2. An image forming apparatus according to claim 1, wherein said controller controls the second drive time on the basis of a history of the information of the first drive time.

3. An image forming apparatus according to claim 1, wherein said controller controls the second drive time on the basis of information of the first drive time.

4. An image forming apparatus according to claim 2, wherein said controller makes the second drive time longer when an image forming job in which the first drive time is less than a predetermined time is repetitively executed predetermined times, than when an image forming job in which the first drive time is not less than the predetermined time is executed.

5. An image forming apparatus according to claim 1, wherein said controller stops rotation of said developer carrying member before said screw member is stopped when the second drive time is made longer than a set time.

6. An image forming apparatus according to claim 1, wherein when the first drive time is shorter than a predetermined time, the controller makes the second drive time longer than a remaining time obtained by subtracting the first drive time from the predetermined time.

7. An image forming apparatus according to claim 1, wherein said controller changes the second drive time by changing drive stop timing of said screw member relative to drive stop timing of said developer carrying member.

8. An image forming apparatus according to claim 3, wherein said controller sets the predetermined time at a larger value with an increase in cumulative use time of the developer, a temperature rise of the circulation path or an increase in absolute humidity of the circulation path.

9. An image forming apparatus according to claim 1, wherein said controller makes the second drive time longer with a shorter first drive time when the first drive time is shorter than a predetermined time.

* * * * *